US006406217B1

(12) United States Patent
Daniel et al.

(10) Patent No.: US 6,406,217 B1
(45) Date of Patent: Jun. 18, 2002

(54) LIFTING AND PLACING DEVICE FOR SEABED MATS

(75) Inventors: David R. Daniel, Madisonville; Derek W. Dice, Bowling Green, both of KY (US); Todd D. MacNeill, Buford, GA (US); Kenneth L. McAllister; Thomas E. Wimp, both of Bowling Green, KY (US)

(73) Assignee: Lee Masonry Products, LLC, Bowling Green, KY (US)

( * ) Notice: Subject to any disclaimer, the term of this patent is extended or adjusted under 35 U.S.C. 154(b) by 0 days.

(21) Appl. No.: 09/927,117

(22) Filed: Aug. 10, 2001

(51) Int. Cl.[7] ..... E02B 3/12
(52) U.S. Cl. ..... 405/17
(58) Field of Search ..... 405/15, 17, 19, 405/20, 158, 166, 173; 114/51

(56) References Cited

U.S. PATENT DOCUMENTS

| | | | | |
|---|---|---|---|---|
| 1,619,331 A | | 3/1927 | Chenoweth | 405/17 |
| 2,232,564 A | * | 2/1941 | Schwarz et al. | 114/51 |
| 4,407,606 A | | 10/1983 | Larsen | 405/17 |
| 4,469,468 A | | 9/1984 | Larsen | 405/157 |
| 4,486,120 A | | 12/1984 | Landry, Jr. | 405/17 |
| 4,906,130 A | | 3/1990 | Manley, Jr. et al. | 405/15 |
| 5,193,937 A | | 3/1993 | Miller | 405/157 |
| 5,449,020 A | | 9/1995 | Matiere | 138/103 |
| 5,476,343 A | | 12/1995 | Sumner | 405/157 |
| 6,106,194 A | | 8/2000 | Angel et al. | 405/17 |
| 6,139,220 A | | 10/2000 | Angel et al. | 405/17 |

FOREIGN PATENT DOCUMENTS

| | | |
|---|---|---|
| GB | 1 558 427 | 1/1980 |
| GB | 2 084 286 A | 4/1982 |

* cited by examiner

*Primary Examiner*—Thomas B. Will
*Assistant Examiner*—Tara L. Mayo
(74) *Attorney, Agent, or Firm*—John F. Salazar; Middleton Reutlinger

(57) ABSTRACT

A lifting and placement device for seabed mats. The device has a frame made of a first and second support beam each of which have a release shaft located adjacent thereto. The release shafts are rotatably engaged to a central actuation shaft that when turned cause the release shafts to rotate thereby removing displaceable support pins from retaining supports. Once the support pins are released from the supports, a seabed mat which is supported below the device is released on all sides of the frame. The device has the ability to connect a plurality of frames in end to end relationship allowing a single rotational force applied to an actuation lever to be transmitted along the conjoined frames.

19 Claims, 5 Drawing Sheets

LIFTING AND PLACING DEVICE FOR SEABED MATS

BACKGROUND OF THE INVENTION

1. Field of the Invention

The present invention relates to frames for lifting and placement of seabed mats and particularly to concrete seabed mats.

2. Review of the Prior Art

Various types of mats have been used to provide stabilization and protection to underwater pipes and other seabed installations. Particularly, articulated mats are used for off shore coastal and marine applications where separation, stabilization, protection and scour prevention is needed for pipelines and underwater installations. Hydrodynamic forces, which are generated by the bottom currents and waves, create a need for a stabilization technique, such as a seabed mat. Prevention of erosion of the adjoining seabed is also another benefit created by a seabed mat.

Many of the difficulties associated with the prior art lifting and placement devices of seabed mats are identified in U.S. Pat. No. 6,139,220, which includes the difficulty of obtaining accurate placement of the mat, tangling of multiple releasing aligning guides, slow release of the mat once it has been properly positioned and pollution to the environment. In placements of seabed mats, it is essential that a mat be able to be released simply, accurately and timely. Additionally, given that the mats are typically placed in an underwater setting, the process of connecting the mat to the lifting and placement device must also be a simple and safe process.

Typically, in the field, seabed mats are stacked upon each other, several layers high. The lifting and placement device is then maneuvered to the top mat. Climbing up on these stacked mats to connect the lifting device to the mat presents a dangerous situation when working in a wet and turbulent environment such as a boat in the middle of the ocean or other large body of water. Therefore, there is a need for a lifting and placement device for seabed mats that allow for a safe and easy way to connect the mat to the lifting device, without endangering the individual performing the task.

SUMMARY OF THE INVENTION

The present invention provide a lifting and placement device for concrete seabed mats having a frame for supporting the mats and a release mechanism which adequately supports the mats on opposite sides of the frame and which proves stable when supporting the heavy material.

The present invention further provides for a lifting and placement device for seabed mats which has an actuation lever and in which the design allows for multiple lifting devices to be placed in end to end relationship.

All of the above outlined objectives are to be understood as exemplary only and many more objectives of the invention may be gleaned from the disclosure herein. Therefore, no limiting interpretation of the objectives noted are to be understood without further reading of the entire specification and drawings included herewith.

BREIF DESCRIPTION OF THE DRAWINGS

DETAILED DESCRIPTION OF THE PREFERRED EMBODIMENT

Figure 1:
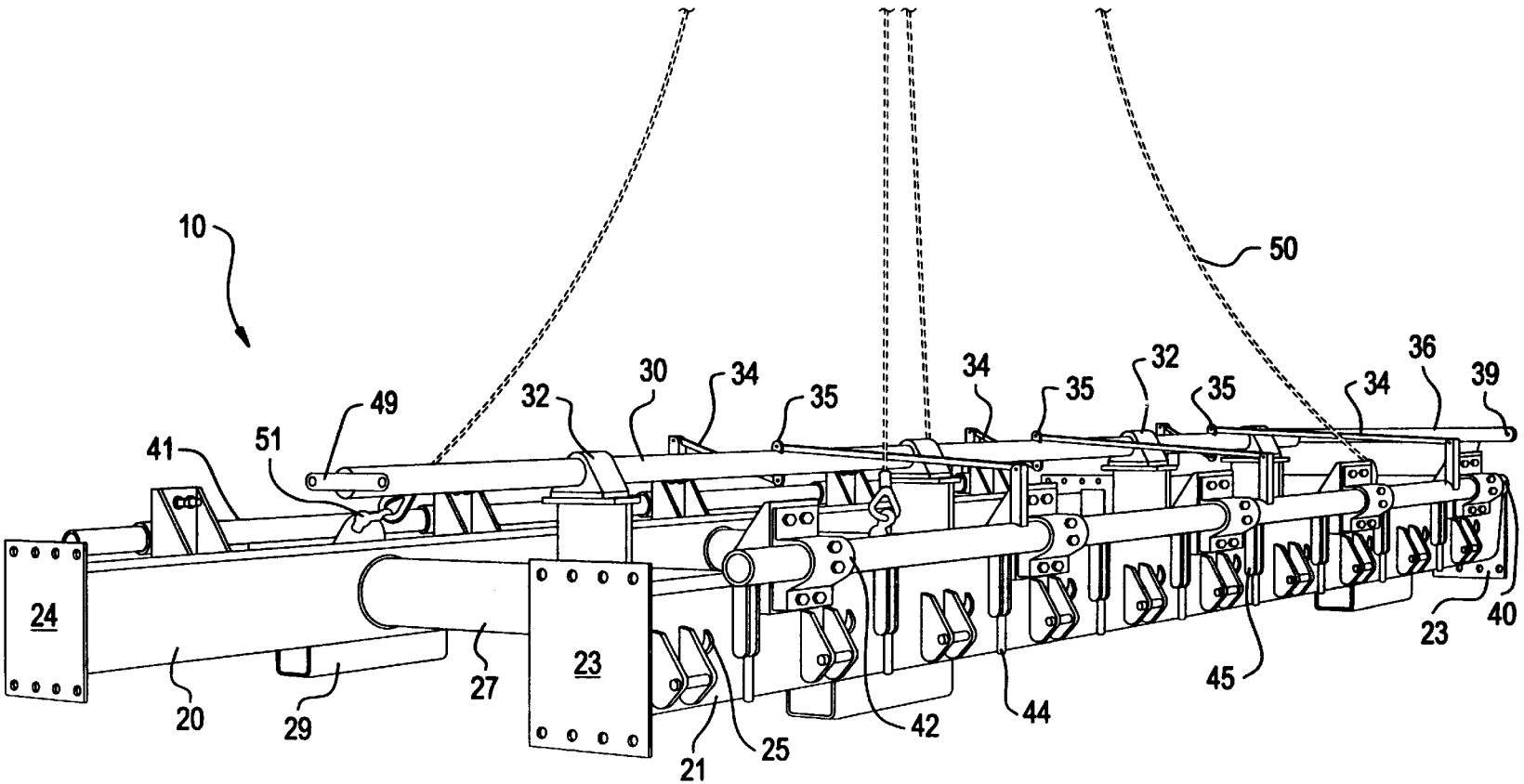
FIG. 1 is a perspective view of the device of the present invention.

The seabed placement device 10 of the present invention is depicted in FIG. 1. The placement device 10 of the present invention provides for direct and concise placement of seabed mat 70 in an underwater environment or in other areas. The seabed mat placement device 10 of the present invention fully supports the seabed mat until release of the mat by movement of actuation lever 36. The placement device 10 of the present invention may be supported by a crane or other device through support chains 50 which may be raised after the placement device 10 is fully connected to a mat 70. The placement device 10 of the present invention allows for the accurate placement of a mat by activation of a single actuation lever 36 which immediately releases all retaining mechanisms supporting the mat 70 below the placement device 10. Thus, the placement device 10 of the present invention allows the mat 70 to be placed in the proper position and then accurately released on all sides in a single movement. Release of the mat 70 from the placement device 10 may be effectuated by simple rotation of an actuation lever 36 located at a far end of the placement device 10. Rotation of the actuation lever 36 will automatically release all supporting pins 44 which retain the seabed mat 70 through use of the mat support lines 72 and support straps 57. Thus, automatic and full release of the supported seabed mat 70 may be completed from an adjacent or remote location and not necessarily from an area directly on top of or associated directly on the actuation shaft 30 which is centrally aligned on the placement device 10. Further, the retaining pins holding the mat 70 are located directly above the supported area of the mat thereby ensuring accurate placement of mat 70.

Figure 2:
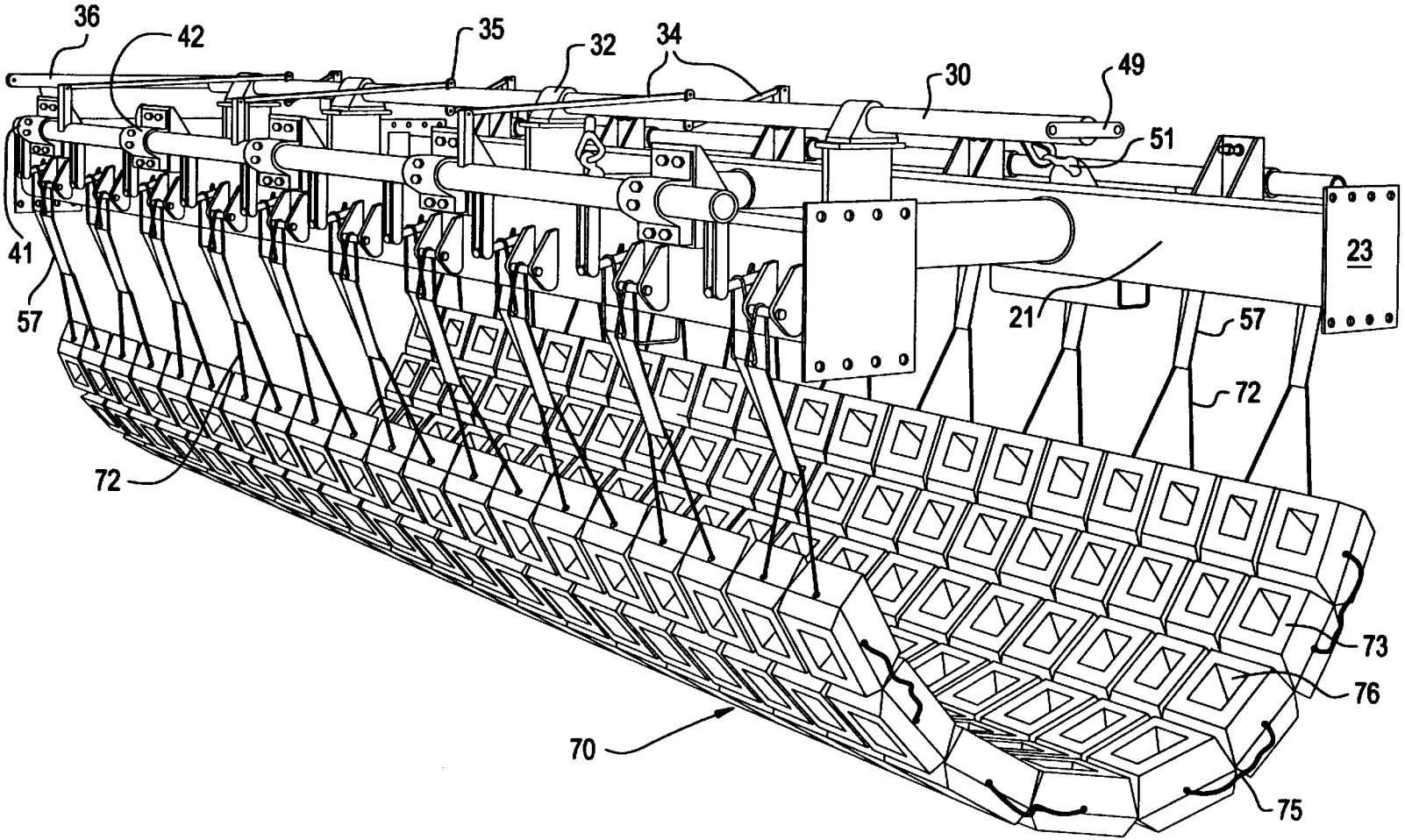
FIG. 2 is a perspective view of the device of the present invention supporting a concrete pad.

As depicted in FIG. 2, the placement device 10 of the present invention will support a seabed mat 70 which may contain a plurality of cement blocks 73. The plurality of blocks 73 may be conjoined in a rectangular shape to form a large mat as is depicted in FIG. 2, all of the blocks attached together longitudinally and laterally by mat support lines 72 and 75. Thus, each of the individual blocks 73 may receive support lines in perpendicular fashion in order to increase the strength of the seabed mat 70 and allow the entire seabed mat to be raised and lowered by the support lines 72 and 75. Preferentially, the blocks may be designed in hollow form as is depicted in order to form an open cell 76 which thereby reduces the weight of the entirety of the seabed mat 70. The typical mat may be approximately 20 by 80 feet and the placement device 10 of the present invention may be sized to fully support such mat. A preferential mat for utilization with the placement device 10 of the present invention may be found in co-pending U.S. patent application Ser. No. 09/563,171 which is incorporated herein by reference. However, the placement device 10 of the present invention may be utilized in combination with a significant number of devices which require supporting and immediate release from a supporting platform. Thus, the seabed mat placement device 10 of the present invention may not be so construed as to be limited for use in conjunction with the seabed mat described herein and one of ordinary skill in the art may interchangeably utilize a significant number of objects which require support and release.

Figure 4:
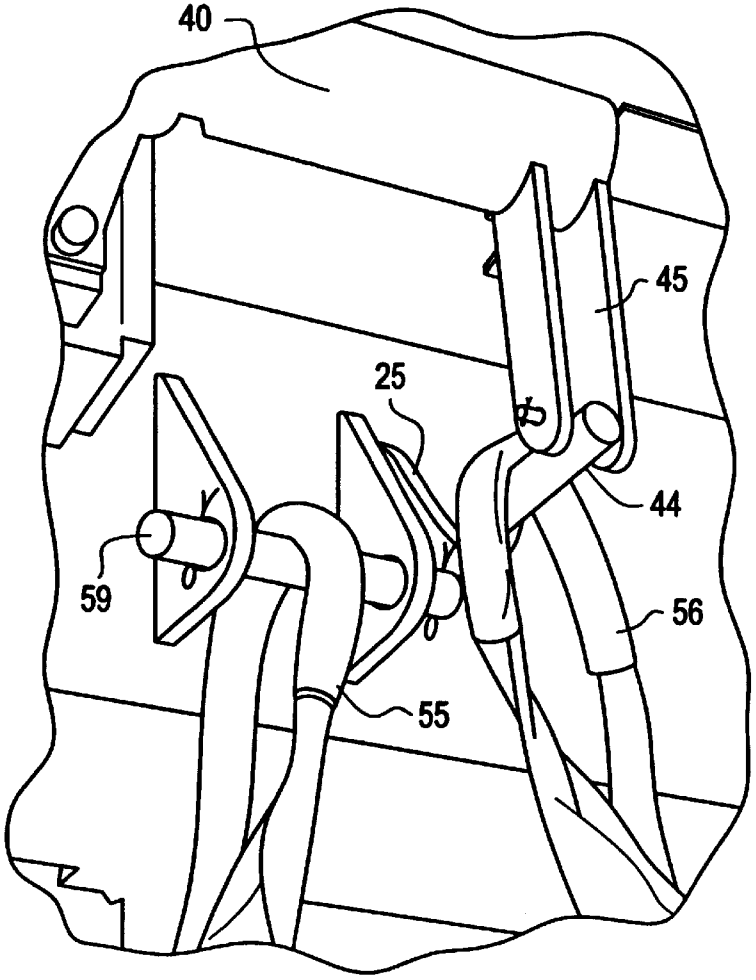
FIG. 4 is a close up of the support and release mechanism for the device of FIG. 1.

As shown in FIG. 2, the mat 70 may be supported by the placement device 10 through the use of a plurality of support straps 57 which wrap around the open loop ends of the block support lines 72. The support straps 57 have a first and a second end, the first end 55 being looped around a retaining pin 59, shown in FIG. 4, while the opposite loop end 56 of the support strap 57 may be retained in place by a displaceable supporting pins 44. The displaceable supporting pins 44 pivotally engage a support bracket 45 and, as is depicted in FIG. 2 and in FIG. 4, are held in place and supported by open ended retaining shelf or support 25. Thus, as is depicted in FIG. 2, the entirety of the seabed mat 70 is fully supported by the seabed mat placement device 10 of the present invention through the use of a plurality of support straps 57 which engage a matching plurality of support line loops 72. The plurality of support straps 57 are supported directly on the placement device 10 through displaceable supporting pins 44 such that upon rotation of actuation lever 36, displaceable supporting pins 44 are removed from the retaining support 25 and the support straps 57 fall through the loops 72 and the entirety of the seabed mat may be displaced and positioned directly below the location of the placement device 10.

As is shown in FIG. 1, the placement device 10 of the present invention may be supported by a plurality of support chains 50 which may depend below a crane or other supporting device. The support chains 50 may be directly connected to a plurality of anchors 51 evenly placed on the device 10 of the present invention so that the entire device may be raised and lowered by the support chains 50 and sufficient structural support should be provided such that the entire device may be lifted with a mat 70 retained there below. By such an arrangement, once the mat 70 is removably attached to the placement device 10, support chains 50 may position the placement device wherever the mat need be located and if such placement is required under water, an additional chain or other attachment device may be provided which is attached to actuation lever 36 such that upon upward force of the attachment chain, actuation lever 36 will cause rotation of the actuation shaft 30 thereby releasing the displaceable supporting pins 44 from the retaining shelf or support 25.

The displacement of the mat may be effectuated in a short span of time by a single rotation force on actuation lever 36. As is shown in FIG. 1, rotation of actuation lever 36 will cause a corresponding rotation in actuation shaft 30. Shaft 30 is rotatably retained along the top of the placement device 10 by a plurality of collars 32 which allow rotation of the actuation shaft 30 therein.

The actuation shaft 30 is supported above the first and second support beams 20 and 21 which have a plurality of cross support members 27 extending there between. Located adjacent each of the first and second support beams 20 and 21 are a first and second release shaft 41 and 40 which are rotatably connected to the actuation shaft 30. The first and second release shafts 40 and 41 are rotateably retained on the first and second support beams 20 and 21 by a plurality of support collars 42 which anchor the release shafts but which allow rotatable movement therein. Each of the first and second release shafts 40 and 41 are rotatably attached to the actuation shaft by a plurality of driver arms 34 which are pivotally connected to the actuation shaft 30. Thus, rotation of the actuation shaft 30 causes similar rotation in each of the first and second release shafts 40 and 41.

Different size shafts may be utilized for the actuation shaft or for the release shafts which will cause varying translation of rotation between each other. Thus, a larger actuation shaft may be supplied thereby causing significantly more rotational displacement of each of the release shafts depicted.

The release shafts 40 and 41 are rotatably engaged to the actuation shaft 30 by the plurality of driver arms 34. Each of the driver arms are fixed to the actuation shaft 30 at pivot points 35. The driver arms 34 which connect the second release shaft 40 are pivotally attached to the actuation shaft 30 along a 180° displacement point to the pivot point of the attachment of the driver arms which rotatably engage the actuation shaft 30 to first release shaft 41. Thus, rotation of the actuation shaft 30 will cause opposite rotation of each of the release shafts thereby causing displaceable supporting pins 44, found on either side of the placement device 10, to simultaneously be removed from the open ended retaining shelf 25 found on first and second support beams 20 and 21.

As is shown in FIG. 2, the seabed mat 70 is fully supported by the placement device 10 of the present invention and rotation of lever 36 upward from its position as is depicted in FIG. 2 will cause clockwise rotation of first release shaft 41 and counter-clockwise rotation of second release shaft 40. Thus, the entirety of the seabed mat 70 may be released in consistent fashion with all of the displaceable supporting pins 44 being removed from the retaining shelves 25 in direct fashion thereby providing for accurate placement of the mat 70 upon release from the placement device 10. Further, as the seabed mat 70 is supported by the frame 10 in direct alignment, meaning the block support loops 72 are held and supported by the frame 10 directly thereabove along the outer sides of first and second support beams 20 and 21, the entire system is much more stable and more accurate placement of the mat when release occurs.

As is shown in FIG. 1 and FIG. 2, one benefit of the seabed mat placement device 10 of the present invention is that the seabed mat 70 may be releaseably attached to the placement device 10 along the outer sides of the first and second support beams 20 and 21. Thus, a worker who must affix the support straps to the placement device 10 will not be required to stand on the placement device, which may be hazardous, and may merely stand on the periphery of the device while affixing the support straps 57 to the loops formed by block support lines 72. Further, by suspending the support mats directly from the first and second support beams 20 and 21, the majority of the weight of the seabed mat 70 is supported by the support beams 20 and 21 and the anchors 51 thereby evenly displacing the total weight of the seabed mat 70. Such a design therefore makes positioning of the seabed mat placement device 10 while a seabed mat 70 is held there below readily, easily and accurately by support chains 50.

Figure 5:
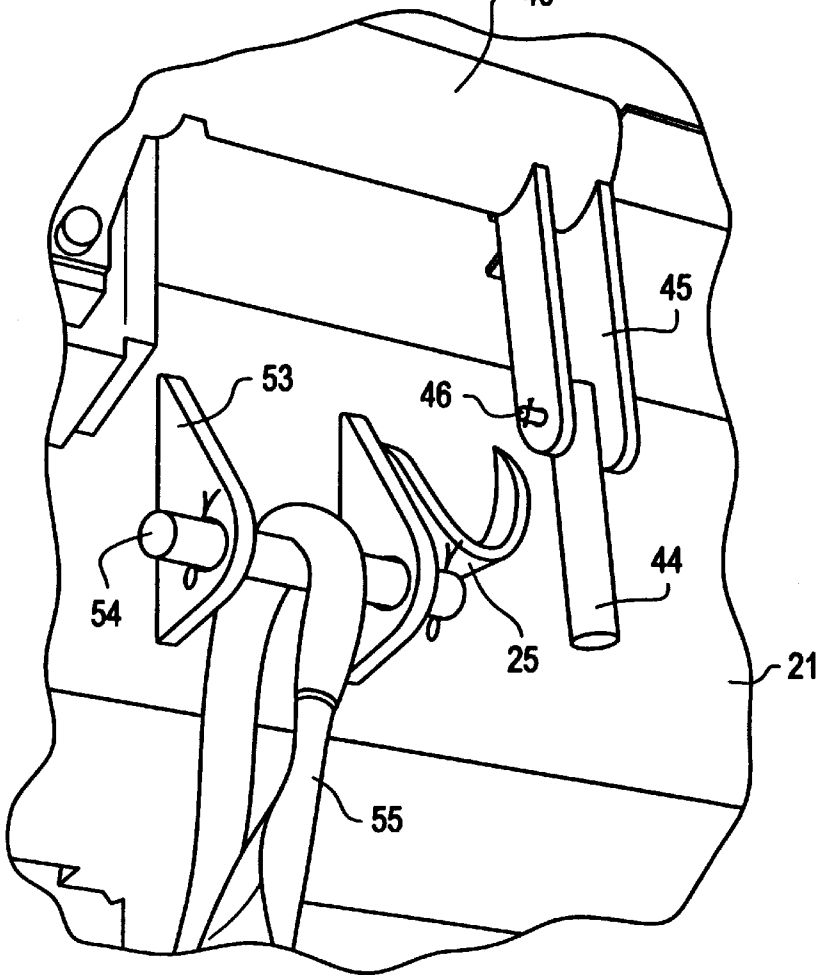
FIG. 5 is a close up of the support and release mechanism for the device of FIG. 1.

As is shown in FIG. 4 and FIG. 5, rotation of actuation lever 36 will cause the displaceable supporting pins 44, which are retained within the retaining shelf or supports 25 to move outward and away from the retaining shelf. As is depicted in FIG. 4, the seabed mat is fully supported and suspended below the placement device 10. The weight of the seabed mat 70 maintains adequate downward force on the displaceable supporting pin 44 and on the retaining shelf 25 such that the pin 44, which swivels about and is supported by supporting bracket 45, fully supports and maintains the mat in suspended form as depicted in FIG. 2. Once the displaceable supporting pin 44 is pulled outward and away from the retaining shelf 25 by rotation of the release shaft 40, loop end 56 falls through the loop 72 formed by block support lines.

As is depicted in FIG. 1, the placement device 10 of the present invention has first and second support beams 20 and 21. Found at either end of each of the support beams are end plates 24 and 23 which provide a flat planar surface for attachment in end to end relationship of a plurality of the placement devices. Thus, if larger mats need to be suspended and accurately placed, the placement device 10 of the present invention may be adhered together in end to end relationship by abutting end plates 23 and 24 to opposing end plates 23 and 24 on a second placement device. Additionally, actuation shaft 30 may be of significant length such that the end which is opposite to actuation lever 36 may have a connection bar 49 which may additionally be attached to the actuation lever of the second placement device. Thus, rotational force applied to actuation lever 36 at one end of a plurality of end to end placement devices will cause corresponding rotation to all of the actuation shafts affixed together. Thus, connection bar 49 would be directly but removeably attached to the actuation lever of the adjacent placement device.

Figure 3:
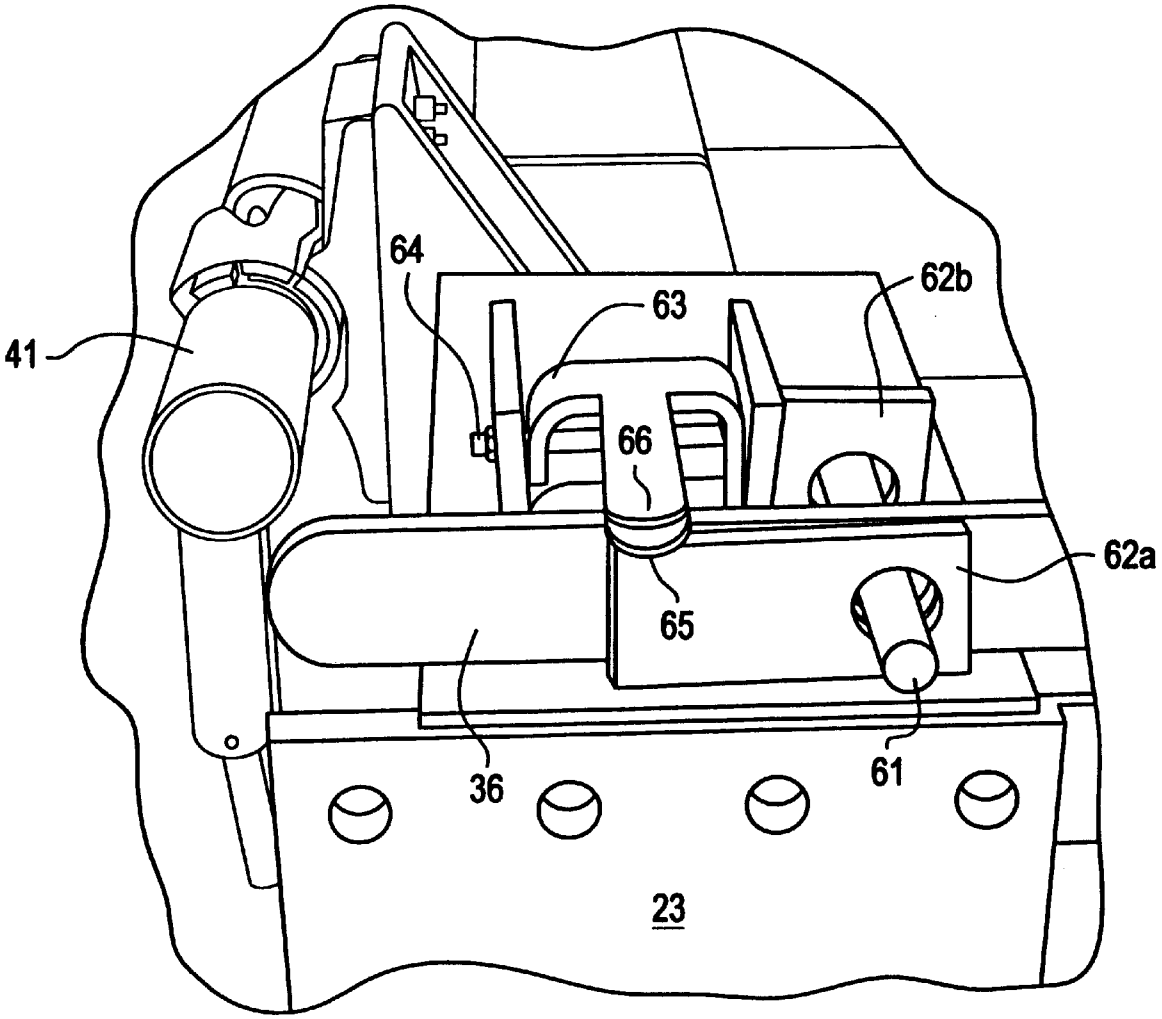
FIG. 3 is a close-up perspective view of the locking device for the actuation lever found on the device in FIG. 1.

As is shown in FIG. 3, the actuation lever 36 may be locked in the downward position such that the seabed mat 70 will not be accidentally released. Thus, this locking of the actuation lever 36 may be effectuated by a locking sleeve 62*a* and 62*b* between which the end of actuation lever is placed. As noted in FIG. 1, actuation lever may have a locking aperture 39 which may receive a locking pin 61 extending through both of the locking sleeves 62*a* and 62*b* and thereby preventing upward rotation of the actuation lever 36. Additionally as is shown in FIG. 3, a latch 63 which is rotatable about latch pin 64 may also provide a secondary safety mechanism which prevents upward movement of the lever 36. Latch 63 may therefore have an outwardly extending tongue portion 66 which mates with a locking sleeve tongue portion 65 both of which may be locked together by an additional locking pin or locking device, not shown, by providing an aperture through both tongues 65 and 26.

The seabed mat placement device 10 of the present invention has support beams and cross support members which may preferably be made of steel or similar material. It may also be preferable that the support beams and cross support members are hollow so as to reduce the weight of the placement device. Further, the actuation shaft and release shafts must be of sturdy design but may also be hollow so as to reduce the weight. The support collars which allow rotateable movement of the actuation shaft or the release shafts may be greased appropriately so that rotational movement of all of these shafts is readily done. All of the support brackets and retaining pins utilized to support the seabed mat may be welded to the side surface of the first and second support beams 20 and 21. Additionally, since a significant amount of weight will need to be supported by the anchors 51, these anchor members 51 should be welded to a rigid and structurally supportive area of the first and second support beams 20 and 21.

Figure 6:
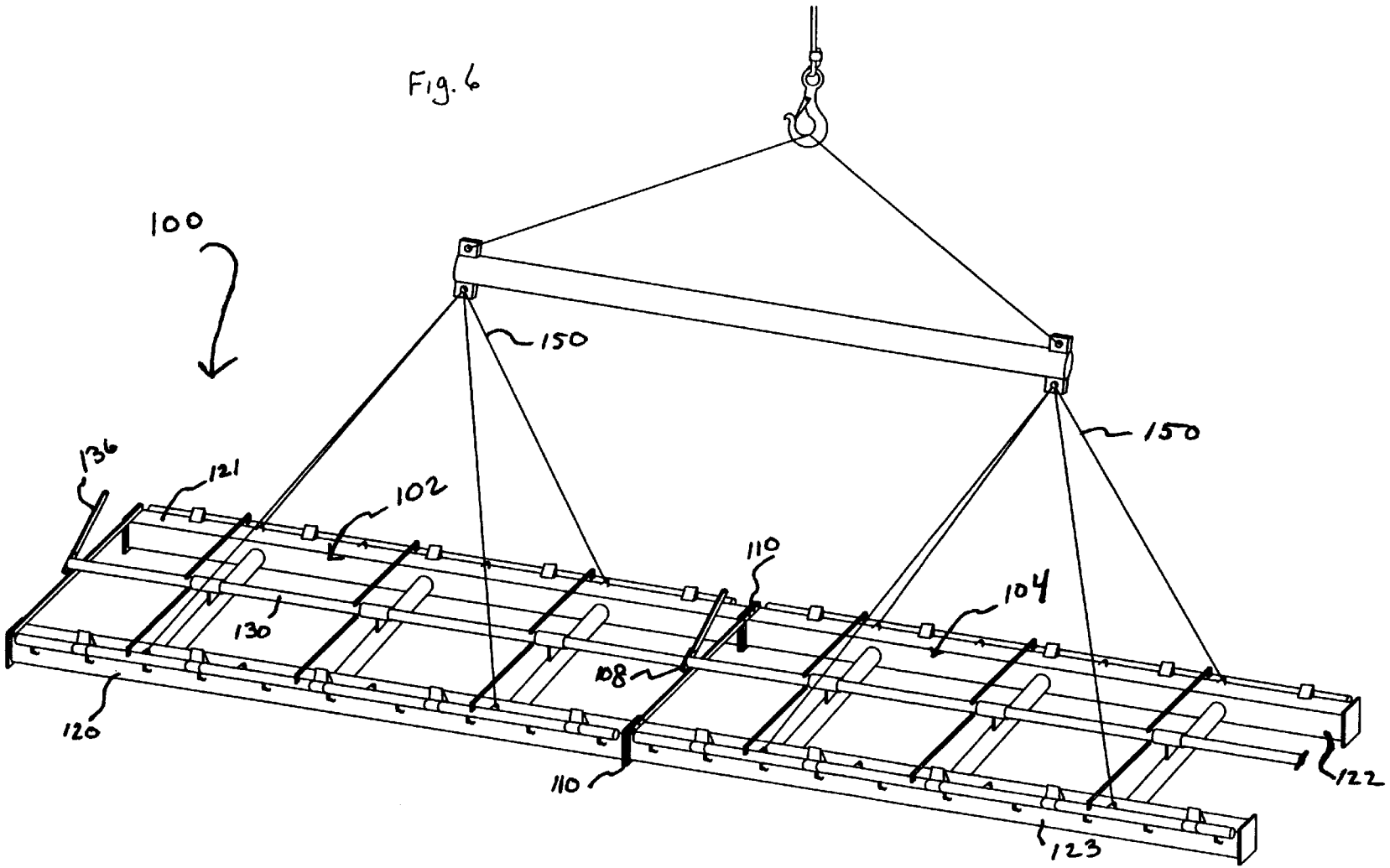
FIG. 6 is a perspective view of the device of the present invention wherein multiple frames are adjoined.

Another benefit of the device of the present invention is shown in FIG. 6 wherein a support and release frame 100 is comprised of a first frame 102 and a second frame 104 placed in end to end abutting relationship. As can be readily seen, the frame 100 had a junction point 110 wherein the first support beam 120 of first frame 102 is adjoined to first support beam 123 of second frame 104. Likewise, second support beam 121 is adjoined to second support beam 122 of second frame 104 so that a double lifting and placement device is created with the ability to support two end to end concrete mats. Thus, rotational force applied to lever 136 drives actuation shaft 130, which is joined to the actuation shaft of the second frame 104 at joint 108. Accurate placement and release of two mats may then be accomplished since the force of the actuation shaft 130 extends along the entire support and release frame 100 thereby driving the driver arms along the entirety of the frame as well as the release shafts for each adjacent frame, which as can be seen need not be connected. The entirety of the frame 100 may be supported by chains 150 and placed where needed in order to accurately release two or more mats.

One skilled in the art will appreciate that the present invention can be practiced by other than the described embodiments which are presented for purposes of illustration only and not by limitation.

We claim:

1. A placement device for sea bed mats, comprising:

a frame having a first and second side surface and a plurality of displaceable supporting pins located on said first and second side surface;

an actuation shaft rotatable on said frame;

a first and second release shaft rotatably connected to said actuation shaft, said first release shaft connected to said plurality of displaceable supporting pins on said first side surface and said second release shaft connected to said plurality of displaceable supporting pins on said second side surface.

2. The placement device of claim 1 wherein said first release shaft is rotatably retained on a first side of said frame and said second release shaft is rotatably retained on a second side of said frame, each of said first release shaft and said second release shaft having a plurality of brackets, said plurality of brackets pivotally attached to said displaceable supporting pins.

3. The placement device of claim 2 wherein said first side of said frame has a plurality of retaining shelves and said second side of said frame has a plurality of retaining shelves, said plurality of shelves receiving said plurality of displaceable supporting pins.

4. The placement device of claim 2 wherein said actuation shaft has a plurality of driver arms attached to said first release shaft and a plurality of driver arms attached to said second release shaft.

5. The placement device of claim 4 wherein said frame further comprises a first support beam and a second support beam and at least one cross support member there between, said first support beam forming said first side surface of said frame and said second support beam forming said second side surface of said frame.

6. The placement device of claim 5 wherein said first release shaft is rotatably mounted on said first support beam by at least one collar, said second release shaft is rotatably mounted on said second support beam by at least one collar.

7. The placement device of claim 6 wherein said actuation shaft has an actuation lever on one end, said frame further having a locking sleeve which receives said actuation shaft.

8. The placement device of claim 6 wherein said actuation shaft is centrally mounted on said frame between said first support beam and said second support beam on said at least one cross support member.

9. The placement device of claim 5 wherein said first support beam has an end plate on both distal ends and wherein said second support beam has an end plate on both distal ends, said end plates allowing said placement device to be affixed end-to-end to adjacent placement devices mating at said end plates.

10. The placement device of claim 5 further comprising a plurality of retaining pins on said first and said second side surface designed to support a plurality of support straps, said support straps having a first and a second loop end, said first loop end of each of said support straps supported by one of said plurality of retaining pins.

11. A seabed mat placement device comprising:

a frame having a first and a second side surface, both of said side surfaces having a plurality of pin receiving supports;

a first and a second release shaft having a plurality of displaceable supporting pins, said first release shaft rotatably mounted on said first side surface and said second release shaft rotatably mounted on said second side surface, an actuation shaft rotatably mounted on said frame and pivotally connected to said first and said second release shaft;

an actuation lever affixed to said actuation shaft.

12. The placement device of claim 11 further comprising at least one cross support member separating said first and said second side surfaces.

13. The placement device of claim 12 further having a first and a second support beam, said first support beam forming said first side surface, said second support beam forming said second side surface, said at least one cross support member separating said first and said second support beam.

14. The placement device of claim 13 wherein said actuation shaft has at least one driver arm pivotally connected to said first release shaft and at last one driver arm pivotally connected to said second release shaft.

15. The placement device of claim 14 wherein at least one of said plurality of displaceable supporting pins is rotatably pinned to said first release shaft and wherein at least one of said plurality of displaceable supporting pins is rotatably pinned to said second release shaft.

16. The placement device of claim 15 further comprising a concrete mat having a plurality of loops extending from a first and second side, a plurality of support straps extending through said loops and held by a plurality of retaining pins on said first and said second side surface of said frame and also held at an opposite end on said placement device by said plurality of displaceable supporting pins, said supporting pins held in said plurality of pin receiving supports.

17. A seabed mat placement device, comprising:

a first and a second support beam separated by at least one cross support member, said first support beam having an outer surface and having located thereon a plurality of retaining pins and retaining supports, said second support beam having an outer surface and having a plurality of retaining pins and retaining supports;

a first release shaft rotatably mounted on said first support beam and having a plurality of displaceable support pins retained on support brackets;

a second release shaft rotatably mounted on said second support beam and having a plurality of displaceable support pins retained on support brackets;

an actuation shaft rotatably mounted on said seabed placement device and pivotally connected to said first and said second release shaft by at least one driver arm;

an actuation lever affixed at one end of said actuation shaft.

18. A seabed mat placement device, comprising:

a first and a second support beam separated by a plurality of cross support members, said first support beam having an outer surface and having located thereon a plurality of retaining pins and retaining supports, said second support beam having an outer surface and having a plurality of retaining pins and retaining supports;

a first release shaft rotatably mounted on said first support beam and having a plurality of displaceable support pins retained on support brackets;

a second release shaft rotatably mounted on said second support beam and having a plurality of displaceable support pins retained on support brackets;

an actuation shaft rotatably mounted on said plurality of cross support members and pivotally connected to said first and said second release shaft by a plurality of driver arms, said driver arms connected to said first release shaft pivotally mounted on a first hemisphere of said actuation shaft, said driver arms connected to said second release shaft pivotally mounted on a second hemisphere of said actuation shaft;

an actuation lever affixed at one end of said actuation shaft and extending outward therefrom.

19. A seabed mat support and release device, comprising:

(a) a first a frame having a first and second side surface and a plurality of displaceable supporting pins located on said first and second side surface;

an actuation shaft rotatable on said first frame;

a first and second release shaft rotatably connected to said actuation shaft, said first release shaft connected to said plurality of displaceable supporting pins on said first side surface and said second release shaft connected to said plurality of displaceable supporting pins on said second side surface;

(b) a second frame having a first and second side surface and a plurality of displaceable supporting pins located on said first and second side surface;

an actuation shaft rotatable on said second frame;

a first and second release shaft rotatably connected to said actuation shaft, said first release shaft connected to said plurality of displaceable supporting pins on said first side surface and said second release shaft connected to said plurality of displaceable supporting pins on said second side surface;

(c) wherein said first frame and said second frame are removably attached in end to end relationship and wherein said actuation shaft of said first frame is affixed to said actuation shaft of said second frame.

* * * * *